US007475525B2

(12) United States Patent
Focke et al.

(10) Patent No.: US 7,475,525 B2
(45) Date of Patent: Jan. 13, 2009

(54) METHOD AND DEVICE FOR PRODUCING PACKS FROM AT LEAST TWO PARTIAL PACKS

(75) Inventors: Heinz Focke, Verden (DE); Doris Focke, legal representative, Verden (DE); Jürgen Focke, legal representative, Verden (DE); Harald Freudenberg, Marklohe (DE); Holger Broek, Kirchlinteln (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 229 days.

(21) Appl. No.: 10/545,939

(22) PCT Filed: Mar. 1, 2004

(86) PCT No.: PCT/EP2004/002043

§ 371 (c)(1),
(2), (4) Date: May 3, 2006

(87) PCT Pub. No.: WO2004/078593

PCT Pub. Date: Sep. 16, 2004

(65) Prior Publication Data

US 2007/0000211 A1 Jan. 4, 2007

(30) Foreign Application Priority Data

Mar. 7, 2003 (DE) ..... 103 10 451

(51) Int. Cl.
*B65B 35/50* (2006.01)
*B65B 7/20* (2006.01)
*B65B 35/30* (2006.01)

(52) U.S. Cl. ..... 53/447; 53/491; 53/153; 53/158; 53/543

(58) Field of Classification Search ..... 53/443, 53/444, 447, 147, 148, 153, 158, 543, 491, 53/461, 173, 575; 206/271, 273, 192
See application file for complete search history.

(56) References Cited

U.S. PATENT DOCUMENTS 4,424,658 A * 1/1984 Focke ..... 53/398

(Continued)

FOREIGN PATENT DOCUMENTS

DE 42 00 921 A1 1/1992

(Continued)

OTHER PUBLICATIONS

PCT International Preliminary Report on Patentability dated Feb. 22, 2006.

(Continued)

*Primary Examiner*—Paul R Durand
(74) *Attorney, Agent, or Firm*—Laurence P. Colton; Smith, Gambrell & Russell

(57) ABSTRACT

The invention relates to a method for producing packs (23) from at least two partial packs (25, 26) to form one groups of packs (21, 22) each of especially cuboid (cigarette) packs (20), a one-piece blank (24) being folded along (embossed) fold lines (46, 47) around the groups of packs (21, 22) in such a way that mutually facing inner walls (27) of the partial packs (25, 26) are folded in between the groups of packs (21, 22) in a V shape. According to the invention, the substantially flat blank (24) is conveyed along a blank path (36) and, during the transport, is at least partially upset in such a way that the inner walls (27) are folded in a V shape along fold lines (46) arranged transversely with respect to the transport direction. The invention also relates to a corresponding device for carrying out the method.

3 Claims, 6 Drawing Sheets

U.S. PATENT DOCUMENTS 4,612,752 A * 9/1986 Deal ..... 53/377.3
4,932,534 A 6/1990 Focke et al.
5,058,363 A * 10/1991 Focke et al. ..... 53/443
5,174,444 A * 12/1992 Adams et al. ..... 206/256
5,181,607 A * 1/1993 Focke et al. ..... 206/273
5,216,870 A * 6/1993 Boriani et al. ..... 53/448
5,311,723 A * 5/1994 Boriani et al. ..... 53/491
5,357,734 A 10/1994 Focke et al.
5,473,862 A * 12/1995 Brizzi et al. ..... 53/447
5,590,763 A * 1/1997 Focke et al. ..... 206/271

FOREIGN PATENT DOCUMENTS

DE 42 23 448 A1 7/1992
DE 195 03 553 A1 2/1995
DE 197 31 509 A1 7/1997

OTHER PUBLICATIONS

DE Search Report No. 103 10 451.8 dated Sep. 30, 2003.
International Search Report dated Jul. 2, 2004.

* cited by examiner

METHOD AND DEVICE FOR PRODUCING PACKS FROM AT LEAST TWO PARTIAL PACKS

This patent application is the US National Phase of PCT/EP2004/002043 having an International Filing Date of 1 Mar. 2004, which was published under International Publication No. WO 2004/078593 A1 on 16 Sep. 2004.

BACKGROUND OF THE INVENTION

1. Technical Field

The invention relates to a method for producing packs from at least two partial packs to form one group of packs each of especially cuboid (cigarette) packs, a one-piece blank being folded along (embossed) fold lines around the groups of packs in such a way that mutually facing inner walls of the partial packs are folded in between the groups of packs in a V shape. Furthermore, the invention relates to a device for producing such packs.

2. Prior Art

Packs of the type mentioned above are used, for example, to accommodate groups of packs having a plurality of cigarettes packs and, in practice, are often designated (double) cigarette cartons. The pack can be divided in such a way that the two partial packs each form independent units with one group of packs of a plurality of cigarette packs, for example five. In order to permit the division of the pack, the partial packs can be connected to each other in the region of a dividing edge having perforations. When the pack is used, the perforation of the dividing edge can be severed by breaking the partial packs. Packs of this type are known, for example from DE 42 00 921.

This prior art also already discloses a device at least a method for producing packs of this type. In this case, blanks are fed to a folding turret and pre-folded to accommodate the groups of packs. In order to fold the inner walls of the blank in a V shape, the blanks are pressed into pockets in the folding turret. Arranged in the pockets are folding elements, specifically thin-walled folding blades, which are designed to taper outward to a point or sharp edge. When the blanks are pressed in, these are placed around the folding blades in order to form the V-shaped fold of the inner walls. One disadvantage of this solution consists in the complex construction of the folding turret, which has a large number of moving elements and is therefore comparatively susceptible to faults. A further disadvantage consists in that, during the folding of the blanks described, the folding blades come into contact with the blank in the region of the dividing edge. Here, unintended severing of the perforation can also occur.

On this basis, the invention is based on the object of further developing a device and a method of the type mentioned at the beginning in particular in such a way that unintended division of the pack into partial packs can reliably be avoided.

BRIEF SUMMARY OF THE INVENTION

In order to achieve this object, the device according to the invention is characterized in that a substantially flat blank can be conveyed on a blank path and, during the transport, can be at least partially upset in such a way that the inner walls are folded in a V shape along fold lines arranged transversely with respect to the transport direction. One advantage of this solution is that the blank does not have to be pressed into pockets of a turret or the like in order to form the V-shaped fold, so that the risk of damage is reduced considerably. It is possible to dispense completely with the use of folding elements which act on the blank in order to fold the latter, so that the device operates so as to take particular care of the material.

In a preferred embodiment of the invention, provision is made for the blank path to be assigned a stop for the edge of the blank located at the front in the transport direction. To the extent to which the blank is conveyed onward in the transport direction after making contact with the stop, the result is partial folding of the blank along the transversely oriented fold lines. In this way, the V-shaped fold of the inner walls can be formed in a simple manner.

In order to transport the blanks along the blank path, drive means, for example drive rollers or rolls, can be provided, which convey the blank to be upset in the transport direction. In order to control the folding operation, the drive means are preferably arranged in such a way that they end at a distance upstream of the stop such that the blank, following correct (V-shaped) folding, can no longer be conveyed by the drive means and thus rests in the blank path as a folded blank. In this case, the blank is preferably arranged in such a way that the inner walls folded in a V-shape are oriented transversely with respect to the plane of the blank path, whereas the remainder of the blank is positioned substantially in the plane of the blank path.

The groups of packs can be conveyed into the blank pre-folded to this extent. For this purpose, provision is made for the groups of packs to be transported along a pack path toward the pre-folded blank, the inner walls folded in a V shape coming between the layers of the groups of packs. The groups of packs can be transported onward in the pack path, carrying the blank along. Here, the blank is folded around the groups of cigarettes in a U shape. This can preferably be done by the groups of packs with the blank being conveyed through an opening, folding the outer walls of the blank against the groups of packs. In a preferred exemplary embodiment, the opening is formed by conveyor bands or conveyor belts of an output conveyor, which is arranged in extension of the pack path.

Further special features of the device according to the invention relate to the joining of side flaps of the blank during the continuous transport on the output conveyor and also to the feeding of the groups of packs to the pre-folded blanks.

A method relating to achieving the object mentioned at the beginning is characterized in that a substantially flat blank is conveyed along a blank path and, during the transport, is at least partially upset in such a way that the inner walls are folded in a V shape along fold lines arranged transversely with respect to the transport direction. The advantages of this method reside in the treatment of the blanks so as to take care of the material, described at the beginning. Unintended separation of the partial packs can reliably be prevented.

Further refinements of the device according to the invention and of the method according to the invention are otherwise presented in the subclaims and the description.

BRIEF DESCRIPTION OF THE DRAWINGS

A preferred exemplary embodiment of the device for producing the blanks and the method sequence will be explained in more detail below by using the drawing, in which.

DETAILED DESCRIPTION OF THE PREFERRED EMBODIMENTS

Figure 1:
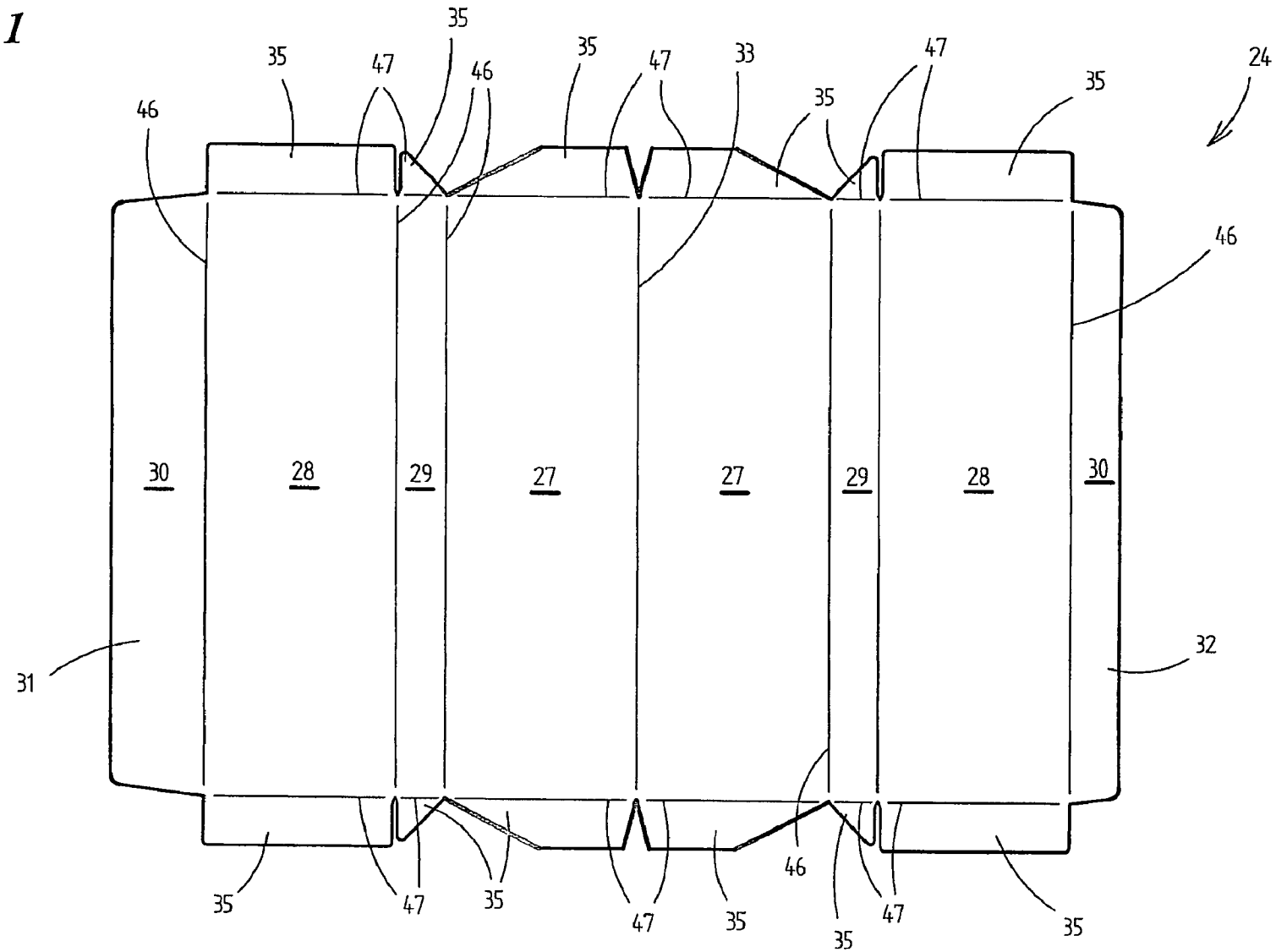
FIG. 1 shows a blank for a pack comprising two partial packs when in the position spread out flat.
Figures 2, 3:
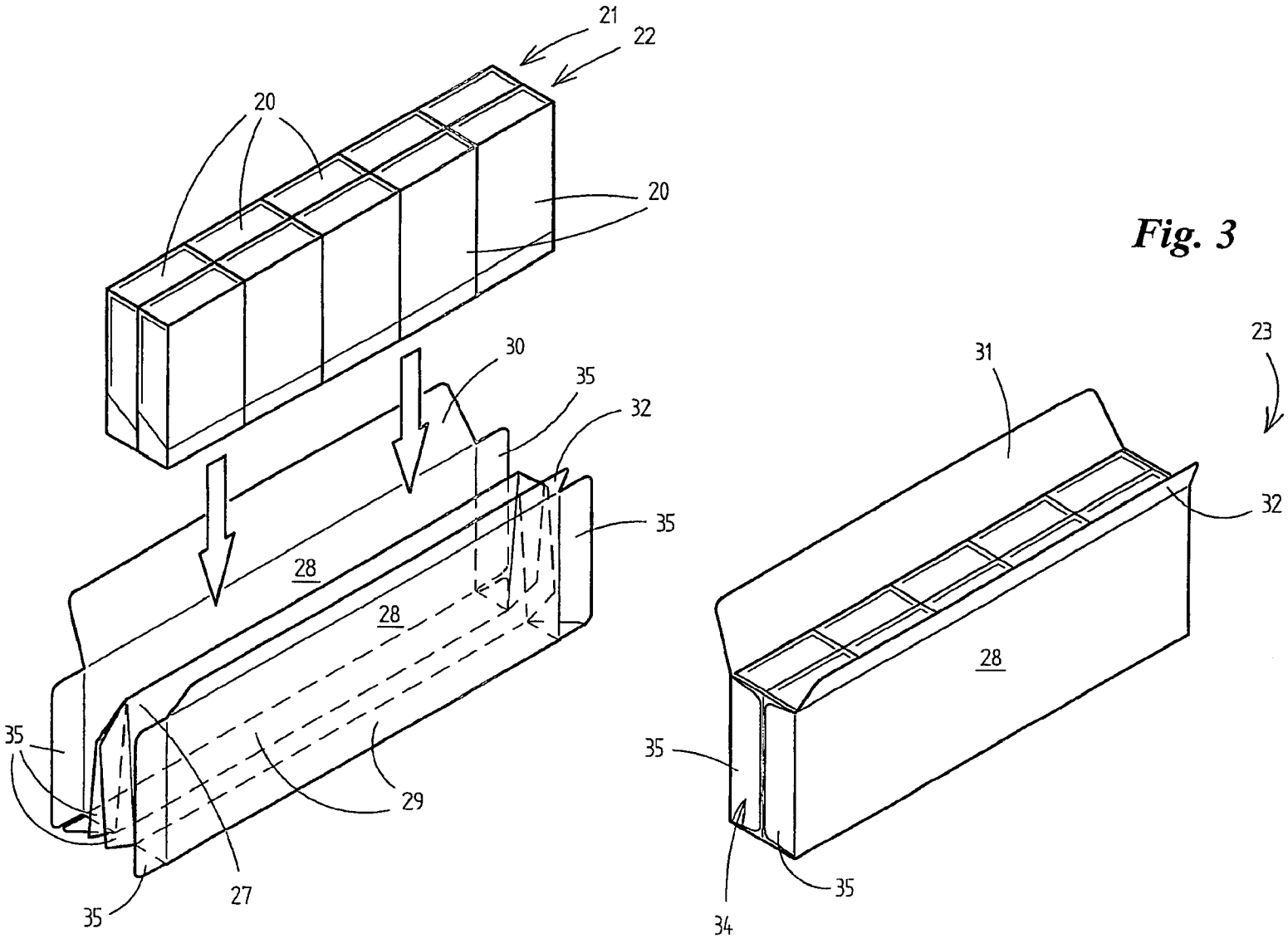
FIG. 2 shows a partly folded blank according to FIG. 1.
FIG. 3 shows a pack from a blank according to FIG. 1 in a perspective view.

The device shown in the figures tackles the production of packs 23 for a plurality of small cuboid packs, specifically cigarette packs 20. Two groups of packs 21, 22 of these cigarette packs 24 are accommodated in a pack 23, also called a cigarette carton. The pack 23 consists of a single-piece blank 24 formed of thin cartonboard or another suitable packaging material. The pack 23 formed from this has two partial packs 25, 26, each to accommodate one group of packs 21, 22 of the cigarette packs 20. In the exemplary embodiment shown, each group of packs 21, 22 consists of five cigarette packs 20.

The blank 24 is formed in such a way that two partial packs 25, 26 enveloping the pack contents completely are formed, each having an inner wall 27, opposite outer wall 28, a first long side wall 29 and a second long side wall 30. The second long side wall 30 is formed by two side flaps 31, 32, which overlap each other and are glued to each other. For this purpose, the side flap 31 has larger dimensions, specifically a greater depth, than the side flap 32, so that, following folding of the blank and the feeding of the groups of packs, the side flaps 31, 32 can be folded over each other with an overlap region. The connection of the side flaps 31, 32 in the region of the long side wall 30 constitutes a preliminary closure of the pack 23. The side flaps 31, 32 are connected with what is known as a stick-no-stick glue. In this way, the pack 23 can easily be opened in order to apply control marks to the cigarette packs 20.

In order to form smaller sales units, the pack 23 can be divided into the two partial packs 25, 26. To this end, the blanks 24 consist of two substantially correspondingly formed halves, each in the form of a partial pack 25, 26. The halves are joined together in the region of mutually facing edges of the inner wall 27 by an edge connection 33 to form one unit, i.e. to form a one-piece blank 24. The edge connection 33 in the present case consists of long punched cuts, not shown, and a few short residual connections by means of which a perforation or a perforation line is formed, which preferably extends completely along the mutually facing edges of the inner walls 27. The two halves of the blank 24 are formed correspondingly in the exemplary embodiment shown, apart from the dimension of the side flaps 31, 32.

The end walls 34 of the pack 23 and of the partial packs 25, 26 consist of specially shaped end flaps 35. These are folded with partial overlap and gluing.

Figure 4:
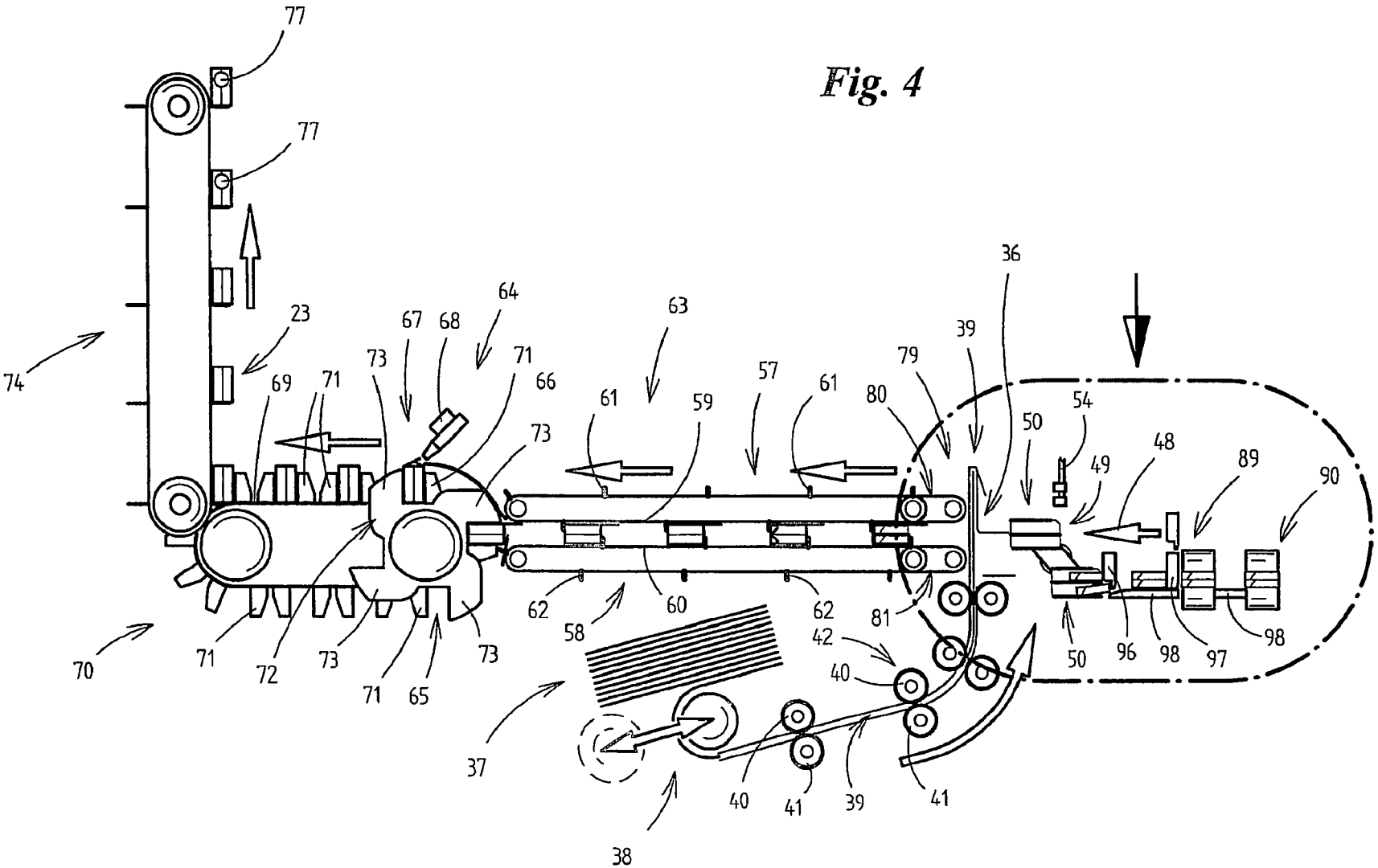
FIG. 4 shows a device for producing a pack according to FIG. 3 in a schematic side view.

The packs 23 described above or formed in a similar way are fabricated in a packaging machine, as illustrated in FIG. 4 et seq. At the center in this case is the folding of a blank 24 to accommodate groups of packs 21, 22. This is carried out in the region of a folding station 36. The blanks 24 are removed from a blank magazine 37 by means of a transfer roller 38 known from the prior art. After that, the blanks 24 are fed to the folding station 36 on a blank path 39. In the blank path 39, the blanks 24 are transported substantially flat, i.e. lying flat and unfolded, with end flaps 35 oriented transversely with respect to the transport direction.

In this case, the transport along the blank path 39 is carried out by a plurality of pairs of drive rollers 40, 41, which serve as drive means 42. The pairs of drive rollers 40, 41 are arranged at the same height on both sides of the blank path 39. In each case two drive rollers 40; 41 are arranged on a common shaft 43. The pairs of drive rollers 40, 41 rest on the flat blanks 24 and transport the latter along the blank path 39 by means of a rotational movement in opposite directions.

In the folding station 36, the blanks 24 are prepared for the feeding of the groups of packs 21, 22, specifically pre-folded. One special feature consists in the manner in which the inner walls 27 of the blanks 24 are folded in a V shape while the blank 24 is being transported in the plane of the blank path 79. To this end, the blank 24 is specifically upset, so that the inner walls 27 come into the desired V-shaped position. The upsetting of the blank 24 in the exemplary embodiment illustrated is carried out by said blank being transported by the pairs of drive rollers 40, 41 against a stop 44 assigned to the folding station. After an edge of the blank 24 located at the front in the conveying direction has come into contact with the stop 44, the forward thrust is continued by the pairs of drive rollers 40, 41 until the blank 24 has assumed the position shown in FIG. 7: the inner walls have been folded in a V shape, whereas the blank 24 is otherwise kept in the plane of the blank path 39. In this case, the inner walls 27 stand transversely with respect to the plane of the blank path 39, specifically approximately perpendicular thereto or, in the exemplary embodiment shown here, are aligned approximately horizontally (FIG. 7).

Figure 9:
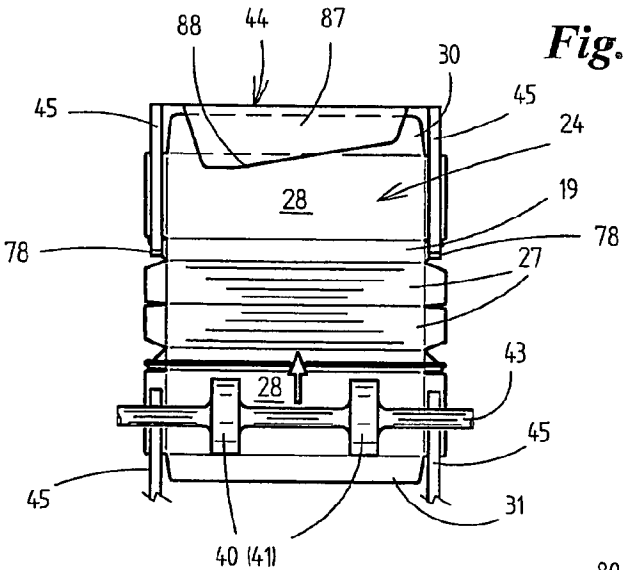
FIG. 9 shows a vertical section along the section line IX-IX shown in FIG. 6.

The exact control of the upsetting operation is carried out in the following way: as can be seen in FIG. 9, the blank 24, when in contact with the stop 44, is partly held in the plane of the blank path 39 in the region of transversely oriented end flaps 35 by guides 45. The guides 45 are arranged in such a way that no guides 45 are arranged at the height of the inner walls 27, that is to say the end flaps 35 in the region of the inner walls 27 are not held in the plane of the blank path 39 by the guides 45. In this way, the inner walls 27 can pivot out of the plane of the blank path 39 as the blank 24 is upset until they reach the position shown in FIG. 7. The inner walls 27 are therefore deflected automatically into the position shown. As results from a comparison between FIGS. 6 and 9, the guides 45 have a limb 78 which is oriented transversely and which is arranged above the folded inner walls 27. The limb 78 serves as a guide element for the end flaps 35 of the blank 24 in the region of the inner walls 27 in the position folded in a V shape according to FIG. 7.

Figure 7:
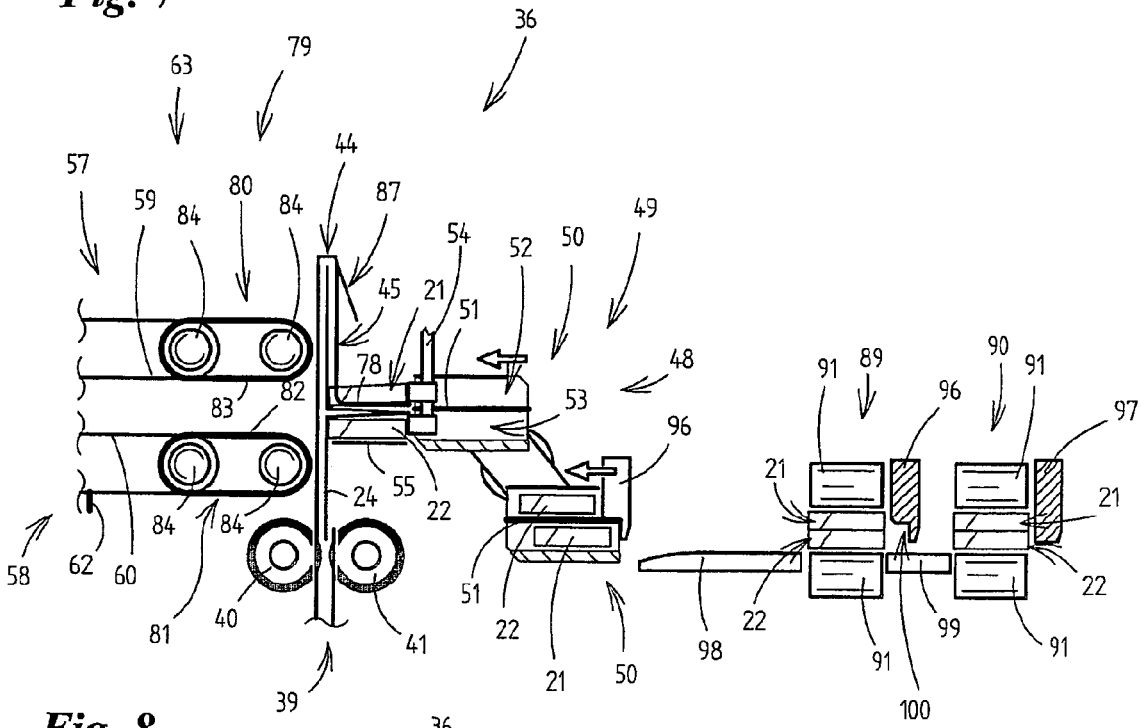

Following the completion of the above-described pre-folding of the blank 24, that is to say after reaching the arrangement shown in FIG. 7, the blank 24 is no longer in contact with the pairs of drive rollers 40, 41. For this purpose, the pairs of drive rollers 40, 41 are arranged at a distance from the stop 44 such that the blank 24 runs automatically out of the active range of the pairs of drive rollers 40, 41 when the pre-folding has been completed. In this way, the pairs of drive rollers 40, 41 can be driven continuously and do not have to be stopped.

The upsetting of the blank 24 can in principle also be carried out in another way. For example, it is conceivable, instead of the stop 44, to provide further pairs of drive rollers which run more slowly than the pairs of drive rollers 40, 41 or which even convey the blank in the direction counter to the transport direction of the pairs of drive rollers 40, 41. In this way, the above-described pre-folding can likewise be effected. The stop 44 can be formed as a metal sheet folded over repeatedly at the edge, as in the exemplary embodiment shown, which is arranged in the region of a free end of the blank path 39.

As can be seen from FIG. 1, the walls 27 to 30 of the blank 24 are connected to one another by (embossed) fold lines 46 or the like. Further fold lines 47 are arranged between end flaps 35 and the side walls 27 to 29. The fold lines 46 assist the pre-folding of the blank 24 with the inner walls 27 folded in a V shape according to FIG. 7. As it is upset, the blank 24 is folded along the fold lines 47 running transversely with respect to the transport direction in the region of the inner walls 27.

As shown in FIG. 4, the blank path 39 initially runs obliquely upward in the transport direction and then in an upright plane which is preferably oriented approximately vertically. Oriented transversely with respect to this section of the blank path 39, namely preferably horizontally, there runs a conveying section for cigarette packs 20, which are conveyed along a pack path 48. The blank path 39 and the pack path intersect or cross in the folding station 36.

Cigarette packs 20 are transported along the horizontally oriented pack path 48 in the form of groups of packs 21, 22. Each group of packs 21, 22 consists of five cigarette packs 20, which are arranged lying beside one another in the same plane. As can be seen from FIGS. 6 and 7, the groups of packs 21, 22 are arranged one above another in layers and are conveyed into the pack path 48 by a turret 49. The (two) pockets 50 of the turret 49 have a horizontally oriented dividing web 51, so that (upper and lower) holders 52, 53 for one group of packs 21, 22 in each case are formed in each pocket 50 of the turret 49.

The groups of packs 21, 22 are raised and pivoted into the plane of the pack path 48 by the turret 49, specifically in such a way that the group of packs 21 in the upper holder 52 is preferably arranged slightly above the inner walls 27 folded in a V shape and tapering to a point (FIG. 7). In this case, the group of packs 21 in the lower holder 53 is arranged slightly below the folded inner walls 27. By means of a slider 54, the two groups of packs 21, 22 are transported toward the pre-folded blank 24, specifically in such a way that the upper group of packs 21 comes to lie on the folded inner walls 27, while the group of packs 22 is pushed toward the blank 24 underneath the folded inner walls 27. As can be seen from the figures, the turret 49 is arranged with a lateral spacing from the blank path 39, in order not to hinder the upsetting of the blanks 24.

Figure 5:
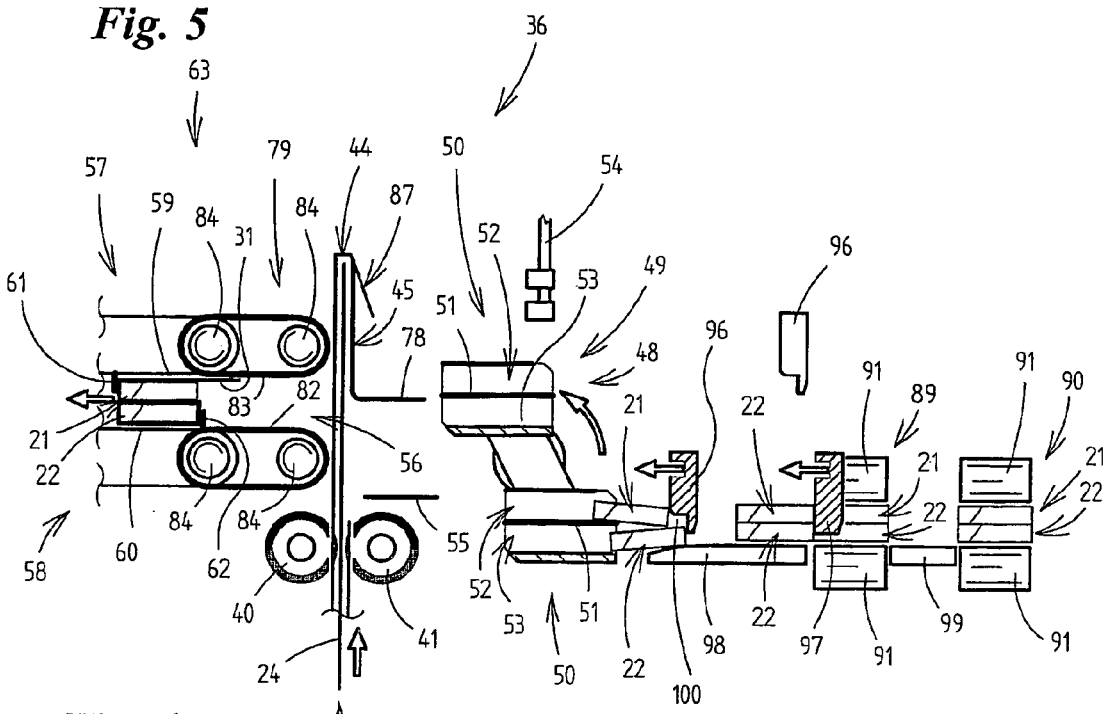
FIG. 5 to FIG. 8 show a detail of the device according to FIG. 4 on an enlarged scale in successive phases of the production of the packs.
Figure 6:
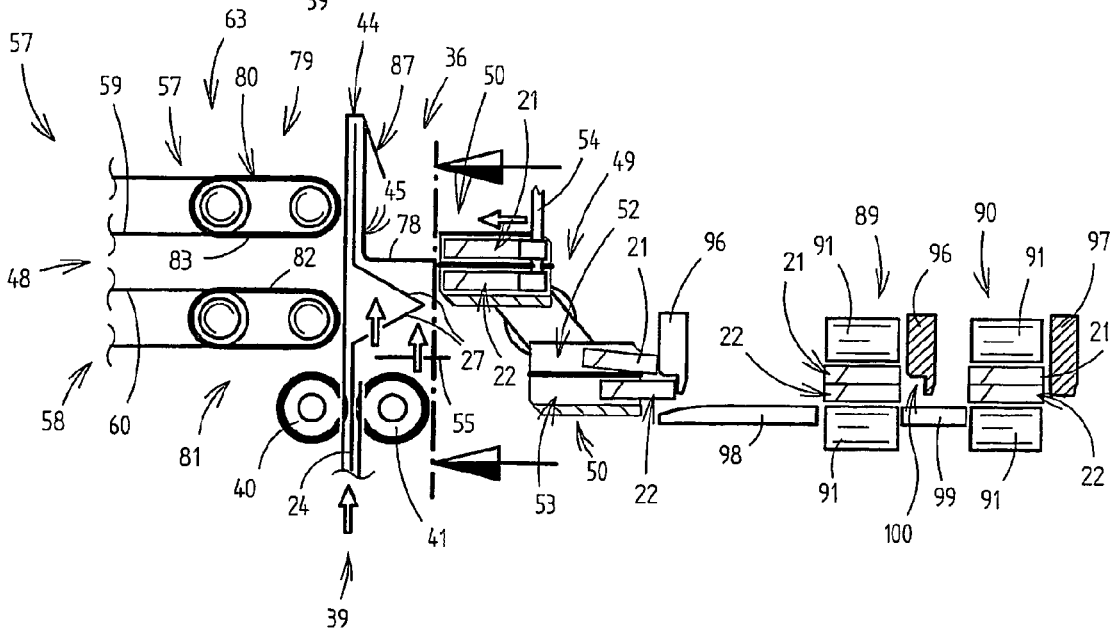

In order that the lower group of packs 22 does not fall off during the transport toward the blank 24, a bridge 55 which can be moved up and down is provided. The bridge 55 is lowered into a rest position (FIG. 5 and FIG. 6). Before the transport of the groups of packs 21, 22 toward the pre-folded blank 24, the bridge 55 is moved into an upper position, in which it supports the lower group of packs 22 on the underside.

Figure 8:
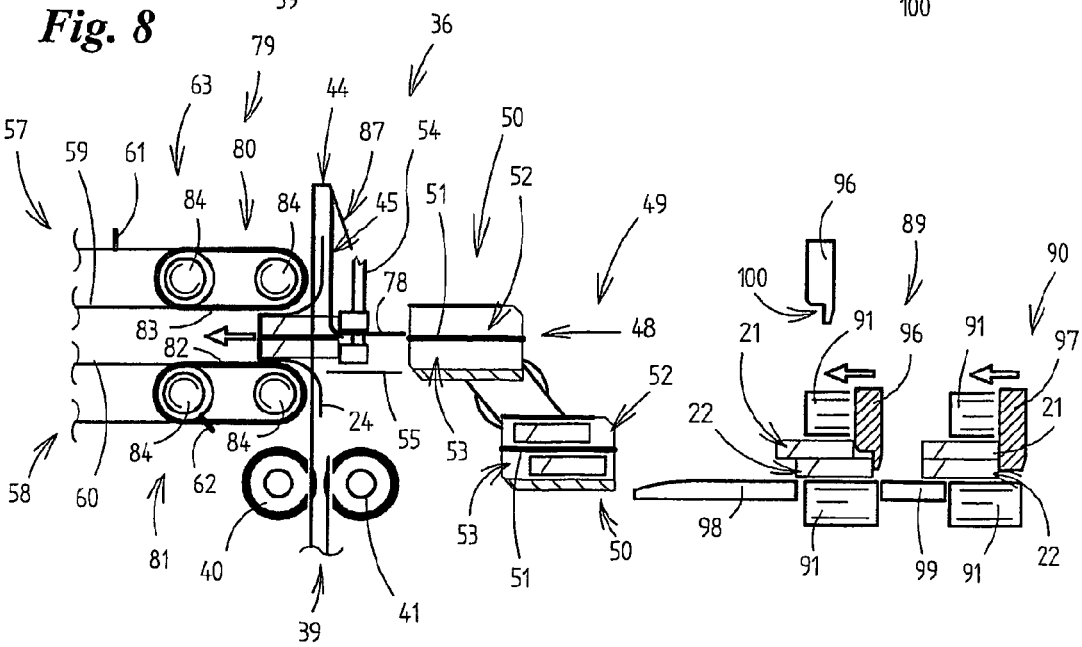
Figure 10:
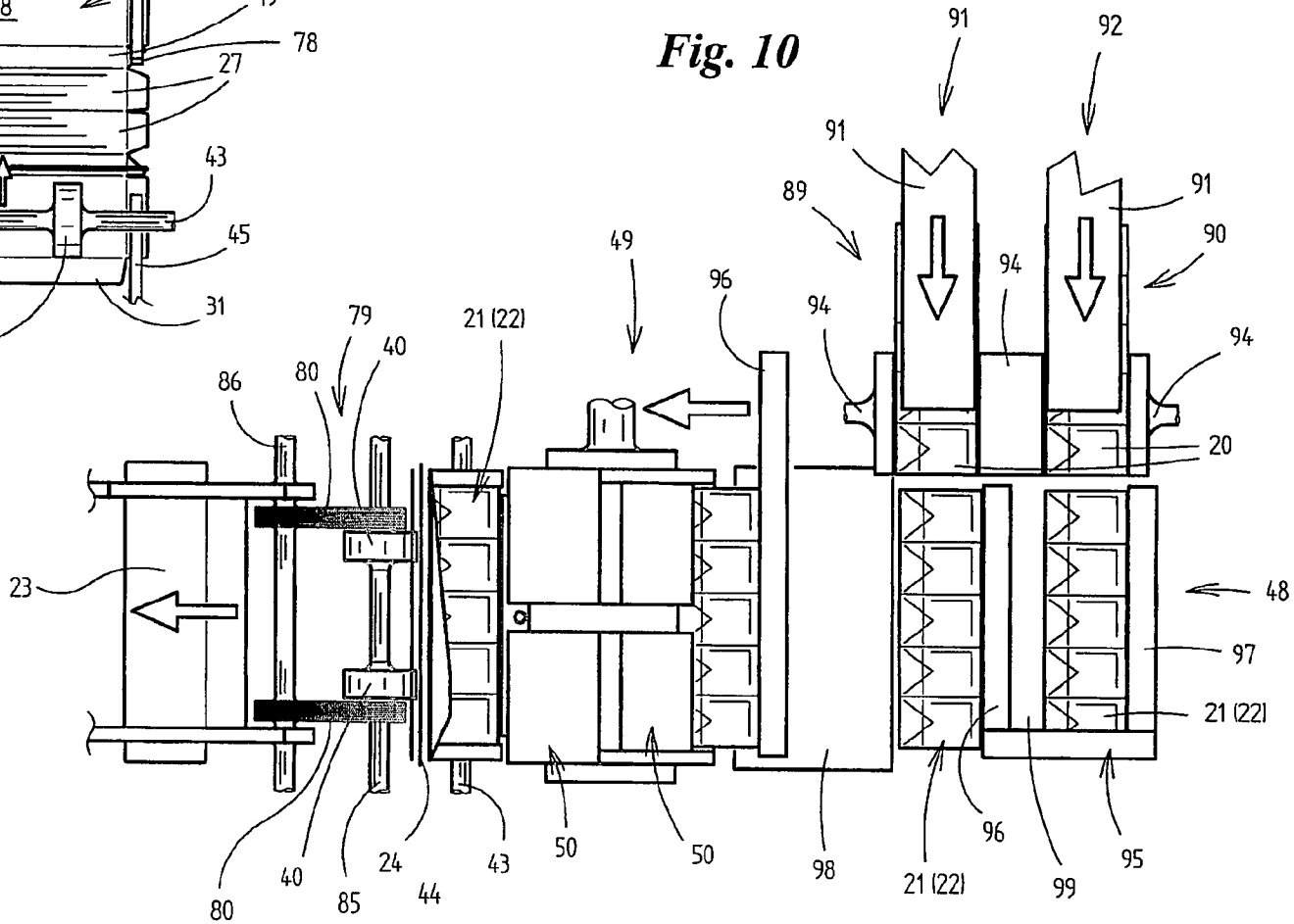
FIG. 10 shows the detail of the device according to FIG. 5 to FIG. 8 in a plan view.

To continue the folding of the blank 24, the transport of the groups of packs 21, 22 along the blank path 48 is continued, carrying along the blank 24 in a U shape, outer walls 28 of the blank 24 being folded toward corresponding surfaces of the groups of packs 21, 22 (FIG. 8). In the exemplary embodiment shown, this is done by the groups of packs 21, 22 being conveyed through an opening 56, carrying the blank 24 along, said opening being formed between two conveyor bands 57, 58 or conveyor belts 80, 81 of an output conveyor 63. Alternatively, it is conceivable for the groups of packs 21, 22 together with the blank 24 to be pressed into a pocket-shaped holder, for example of a folding turret. The two conveyor bands 57, 58 are arranged above and below the blank path 48 in such a way that a lower run 59 of the output conveyor band 57 and an upper run 60 of the lower conveyor band 58 run parallel to each other and at a distance from each other which corresponds approximately to the height of the two groups of packs 21, 22. The outer walls 28 of the blank 24 are in this way brought into contact with large-area side surfaces of the groups of packs 21, 22. The conveyor bands 57, 58 each have spaced-apart drivers 61, 62. The drivers 61 on the lower run 59 come into contact with long side walls 29 of the packs 23 which are located in front in the transport direction. Drivers 62 on the upper run 60 come into contact with a lower part of the long side wall 30 located at the rear in the transport dive action, the side flap 32 simultaneously being folded against the lower group of packs 22 (FIG. 5). The other side flap 31 has not yet been folded at this time and projects from the groups of packs 21, 22, parallel to the pack path 48.

As the groups of packs 21, 22 are pushed into the output conveyor 63, the blank 23 is pulled out of the guides 45 of the blank path 39. In order to ensure that the blank 24 slides out of the blank path 39 in a controlled manner, a guide plate 87 is arranged in the region of the stop 44. The guide plate 87 runs obliquely downward, starting from the stop 44 in the plane of the blank path 39 and oriented away from the opening 56 (FIGS. 5 to 8). As the groups of packs 21, 22 are pushed into the output conveyor 63, an upper part of the blank 24 comes into contact with the guide plate 87, so that any abrupt folding-over of the blank 24 is prevented. To this end, a lower edge 88 of the guide plate 87 additionally runs oriented obliquely, for example approximately in a V shape.

One special feature of the output conveyor 63 is that a further endless conveyor 79 is arranged upstream of the conveyor bands 57, 58. The endless conveyor 79 comprises two rubber-coated conveyor belts 80, 81 each having an upper run 82 and a lower run 83, which are arranged in the same plane as the conveyor bands 57, 58. The conveyor belts 80, 81 are led over deflection rollers 84, which are in each case rotatably mounted on shafts 85, 86. The endless conveyor 79 is used to accommodate the blank 24 partly folded around the groups of packs 21, 22 in the output conveyor 63 and to transfer them to the conveyor bands 57, 58. The conveyor bands 57, 58 and the conveyor belts 80, 81 are led over common shafts 86 and in this way can be driven together. This additionally ensures that the drivers 60, 61 run as far as the region of the conveyor bands 80, 81, and thus a reliable transfer of the packs 23 is ensured.

The device is operated in such a way that the blanks 23 are removed individually from the blank magazine 37 and are transported along the blank path 39 by the pairs of drive rollers 40, 41. After the side flap 30 has come into contact with the stop 44, the blank 23 is upset, bending out in the region of the inner walls 27 in such a way that the inner walls 27 are folded in a V shape around the fold lines 46. The remaining side walls 28 to 31 are held in the plane of the carton path 39 by the guides 45. During the upsetting of the blank 23, two groups of packs 21, 22 are raised and pivoted into a pack path 48 by the turret 49 and, while the turret 49 is at a standstill, are pushed out of the turret 49 by a slider 54 toward the pre-folded blank 23, the inner walls 27 folded in a V shape coming between the groups of packs 21, 22 arranged in layers. Groups of packs 21, 22 are pushed onward, carrying the blank 23 with them in a U shape between conveyor bands 57, 58 or conveyor belts 80, 81 of an output conveyor 63, outer walls 28 of the blank 23 being folded toward the groups of packs 21, 22. During the further transport, side flaps 31 are folded toward the lower group of packs 22 by drivers 62 arranged on the conveyor band 58. After that, the end flaps 35 are folded toward each other during the continuous transport of the pack 23 between the conveyor belts 57, 58 and are stuck to each other by means of glue.

Following the preferably horizontally oriented output conveyor 63, the packs 23 are transferred to further turret 64 driven in rotation. The turret 64 has four pockets 65 to accommodate one pack 23 in each case. During the rotation of the turret 64, the radially projecting side flap 31 is pressed toward the already folded side flap 32 by a curved guide element 66. The guide element 66 holds the side flaps 31, 32 in this position until the pack 23 reaches a gluing station 67, in which the side flaps 31, 32 are connected with a stick-no-stick glue. To this end, the gluing station 67 is assigned a gluing unit 68 which becomes active while the cyclically driven turret 64 is briefly at a standstill. As a result of the restoring forces of the material of the blank 23, the side flap 31 stands up again as soon as it is no longer pressed toward the other side flap 32 by the guide element 66. The gluing of the side flaps 31, 32 is in this case carried out immediately after the side flap 31 has stood up again.

Following that, the packs 23 are transported onward in a horizontal direction, specifically on an upper band 69 of an (endless) conveyor 70. The conveyor 70 has drivers 71, between which the packs 23 are held. The conveyor 70 in the exemplary embodiment runs between turret disks 72 of the turret 64, the drivers 71 together with projections 73 distributed appropriately on the periphery of the turret disks 72 forming the pockets 65 of the turret 64. The upper band 69 of the conveyor 70 is followed by a vertical conveyor 74, which has drivers 75 arranged on the outside. The packs 23 are transported toward a band 76 of the vertical conveyor 74 and gripped and conveyed upward on the underside by a driver 75. During the transport on the vertical conveyor 74, the pack 23 is provided with a label 77 on the end wall. Following the vertical conveyor 74, the banks 23 can, for example, be transferred to a carton-filling machine.

In the following text, the feeding of the cigarette packs 20 to the turret 49 will be described, this specifically being a preferred refinement of the invention but not necessarily having to be used. The cigarette packs 20 coming from a cellophane wrapping machine are transported onto axially parallel conveyors 89, 90. Each conveyor 89, 90 comprises two endless conveyors 91 which are guided over deflection rollers and arranged parallel to and above each other, such that two cigarette packs 20 lying flat one above the other can be transported between the mutually facing runs of the endless conveyors 91. The cigarette packs 20 are accordingly supplied on two paths, specifically in two parallel rows 92, 93 with in each case two cigarette packs 20 lying one above the other. In order to form the groups of packs 21, 22 of in each case two layers of five cigarette packs 20 lying one above the other, the conveyors 89, 90 are assigned braking elements 94, which can be moved laterally toward the cigarette pack stream in order in this way to create spaces between the groups of packs 21, 22. A specially constructed slider 95 removes the groups of packs 21, 22 from the rows 92, 93 by means of a movement transverse to the rows 92, 93. The action of pushing the groups of packs 21, 22 off takes place following the conveyors 89, 90. For this purpose, a platform 98, 99, onto which the groups of packs 21, 22 are transported, can be arranged to adjoin the conveyors 89, 90. Alternatively, in the exemplary embodiment shown, provision is made for the endless conveyors 91 located at the top to end before the working range of the slider 95, so that the groups of packs 21, 22 rest freely on the endless conveyors 91 on the underside.

The slider 95 is constructed as a double-wall slider having two slider walls 96, 97 which are each assigned to a row 92, 93. In a first operating cycle of the slider 95, groups of packs 21, 22 from the row 92 are pushed over the platform 98 arranged in the plane of the lower endless conveyor 91 into the holders 52, 53 of a pocket 50 of the turret 49 moved past the platform 98. As a result of an offset 100 in the slider wall 96, the upper group of packs 21 projects in the transport direction with respect to the lower group of packs 22. In this way, the group of packs 21 can be pushed into the turret 49 during the rotational movement of the latter, the group of packs 21 first being pushed onto the separating web 51 and lifted slightly off the lower group of packs 22 as a result of the continuous rotational movement of the turret 49. During further rotation of the turret 49 and further pushing of the groups of packs 21, 22 off by the slider wall 96, the groups of packs 21, 22 are pushed into the holders 52, 53 of the pocket 50 of the turret 49.

During this, the groups of packs 21, 22 from the row 92 are pushed off as far as the platform 98 by the slider wall 97, over the platform 99 arranged between the lower endless conveyors 91. From there, in a second operating cycle of the slider 95, said groups of packs are conveyed by the slider walls 96 into the next pocket 50 of the turret 49 moved past the platform 98. In order to grip the following groups of packs 21, 22, the slider 95 is raised and lowered into an initial position after being guided back.

LIST OF DESIGNATIONS

20 Cigarette pack
21 Group of packs
22 Group of packs
23 Pack
24 Blank
25 Partial pack
26 Partial pack
27 Inner wall
28 Outer wall
29 Long side wall
30 Long side wall
31 Side flap
32 Side flap
33 Edge connection
34 End wall
35 End flap
36 Folding station
37 Blank magazine
38 Transfer roller
39 Blank path
40 Pair of drive rollers
41 Pair of drive rollers
42 Drive means
43 Shaft
44 Stop
45 Guide
46 Fold line
47 Fold line
48 Pack path
49 Turret
50 Pocket
51 Separating web
52 Holder
53 Holder
54 Slider
55 Bridge
56 Opening
57 Conveyor band
58 Conveyor band
59 Lower run
60 Upper run
61 Driver
62 Driver

63 Output conveyor
64 Turret
65 Pocket
66 Guide element
67 Gluing station
68 Gluing unit
69 Upper band
70 Conveyor
71 Driver
72 Turret disk
73 Projection
74 Vertical conveyor
75 Driver
76 Band
77 Label
78 Limb
79 Endless conveyor
80 Conveyor belt
81 Conveyor belt
82 Upper run
83 Lower run
84 Deflection roller
85 Shaft
86 Shaft
87 Guide plate
88 Edge
89 Conveyor
90 Conveyor
91 Endless conveyor
92 Row
93 Row
94 Braking element
95 Slider
96 Slider wall
97 Slider wall
98 Platform
99 Platform
100 Offset

The invention claimed is:

1. A method for the production of cartons (23) comprising at least two partial cartons for groups of packs (21, 22) for cigarettes, comprising the steps of:

transporting a one-piece blank (24) along a blank path (39);

while along the blank path (39), holding the blank (24) in a blank path plane using guides (45), and during the transporting step, the blank (24) contacts a stop (44) and is at least partially buckled along fold lines (46, 47) to form the partial cartons such that mutually facing inner walls (27) of the partial cartons are folded in a V shape along the fold lines (46), inserting the groups of packs (21 22) such that the inner walls (27) are folded between the groups of packs (21 22) and folding the blank (24) around the groups of packs (21 22), wherein the fold lines (46) are arranged transversely to the direction of transport, and wherein the inner walls (27) are not held in the plane of the blank path (39) by the guides (45) and pivot out of the plane of the blank path (39) into the V-shape.

2. The method as claimed in claim 1, wherein the groups of packs (21, 22) have cigarette packs (20) arranged in layers and are transported toward the V-shaped fold and the partly folded blank (24) such that the inner walls (27) of the blank (24), which have been formed in a V shape by the buckling, come between the layers of the group of packs (21, 22).

3. The method as claimed in claim 2, further comprising the step of:

following the transporting of the groups of packs (21, 22), folding the blank (24) into a U shape around the groups of packs (21, 22) by continuing the transport of the groups of packs (21, 22).

* * * * *